United States Patent [19]

Jenkins, Jr. et al.

[11] 4,074,391

[45] Feb. 21, 1978

[54] CRUSH ROLL PLENUM FOR CARDING MACHINES

[75] Inventors: Robert B. Jenkins, Jr.; Jack A. Poindexter, both of Gastonia, N.C.

[73] Assignee: Jenkins Metal Corporation, Gastonia, N.C.

[21] Appl. No.: 760,728

[22] Filed: Jan. 19, 1977

[51] Int. Cl.[2] ..... D01G 15/82

[52] U.S. Cl. ..... 19/107

[58] Field of Search ..... 19/107, 65 CR; 15/300 R, 306 R, 308, 256.51

[56] References Cited

U.S. PATENT DOCUMENTS

| | | | |
|---|---|---|---|
| 3,003,176 | 10/1961 | Goyette | 15/256.51 |
| 3,264,673 | 8/1966 | Scott | 15/256.51 X |
| 3,520,028 | 7/1970 | Crowley, Jr. | 19/107 |
| 3,604,061 | 9/1971 | King, Jr. | 19/107 |

FOREIGN PATENT DOCUMENTS

| | | | |
|---|---|---|---|
| 63,720 | 3/1970 | Germany | 19/107 |
| 982,809 | 2/1965 | United Kingdom | 19/107 |

*Primary Examiner*—Dorsey Newton
*Attorney, Agent, or Firm*—Clifton T. Hunt

[57] ABSTRACT

A combination web cover and suction chamber define a crush roll plenum which communicates with and extends forwardly from the doffer plenum of a suction cleaning system for carding machines. It includes a suction opening closely spaced from the top crush roll and its scraper blade to continuously pick up accumulations of lint taken from the crush roll by the scraper blade. Intermittent blasts of compressed air are directed toward the scraper blade to purge it of accumulations of foreign matter which is blown into the continuous suction current.

1 Claim, 6 Drawing Figures

CRUSH ROLL PLENUM FOR CARDING MACHINES

BACKGROUND OF THE INVENTION

The use of suction cleaning for carding machines has become increasingly important as the speed of production has increased during the past several years. Heretofore, the suction cleaning of carding machines has been generally confined to the area of the lickerin, the area of the doffer roll, and under card cleaning. See for example, U.S. Pat. No. 3,315,320 to Bass et al., U.S. Pat. No. 3,304,582 to O'Neal et al. and U.S. Pat. No. 3,150,415 to Reiterer. See also patent application Ser. No. 587,277 filed Oct. 17, 1966 by John E. Crowley, Jr. entitled DOFFER PLENUM, now abandoned.

The doffer plenum described in the Crowley application is in general use today for the suction cleaning of the doffer end of a carding machine and comprises a plenum of generally arcuate cross-sectional configuration adapted to be positioned directly above and on the doffer cover of a carding machine. The Crowley plenum is connected to a central source of suction and includes a suction inlet facing the nip between the main cylinder and the doffer cylinder and a second oppositely directed suction inlet facing the take off roll and crush rolls. A web cover of planar configuration is hinged to the front edge of the Crowley doffer plenum and extends over the take off roll and toward the crush rolls to protect the doffer cylinder and newly formed web after it leaves the doffer cylinder from contamination by airborne lint and debris.

Despite the protection afforded by the web cover illustrated and described in the Crowley application, the newly formed web as it passes from the take off roll through the crush rolls to the trumpet to be formed into silver is subjected to contamination from the scrapings of the scraper blade conventionally mounted to clean the top crush roll of impurities picked up from the web passing therebeneath.

Prior efforts to automatically remove the accumulations of debris and foreign matter released from the crush roll by the scraper blade include that shown in U.S. Pat. No. 3,355,774 issued Dec. 5, 1967 to Yukimasa Miyagi. Miyagi discloses the direct application of suction to the top and bottom crush rolls at the points where they are engaged by scraper blades. The suction inlets provided by Miyagi are closely spaced to their respective scraper blades and appear to be connected to a source of suction independent of any other suction cleaning apparatus on the carding machine.

U.S. Pat. No. 3,340,577 issued Sep. 12, 1967 to Morrow et al. contains a disclosure of a clearer roll frictionally engageable with and driven by the top crush roll. The clearer roll includes a flap which periodically compresses the debris accumulated on the clearer roll and discards it from the clearer roll. A suction tube is spaced from the clearer roll and its associated crush roll and it is intended that the debris disloged from the clearer roll will be picked up in the suction tube. Actual experience has established that only a portion of the dislodged material finds its way to the remotely spaced suction tube of Morrow.

The Crowley doffer plenum disclosed in said abandoned application Ser. No. 587,277 included suction inlets in the form of the doffer plenum facing the crush rolls and the web cover extending over the take off roll and toward the crush rolls was intended to induce a sufficient negative pressure about the crush rolls to carry away accumulations of lint and foreign matter dislodged at the crush rolls.

Each of the aforesaid efforts to remove the foreign matter released at the crush roll has proven ineffective to reliably and consistently keep the accumulations of foreign matter from falling into the web of processed fibers as it passes from the crush rolls to the trumpet to be formed into sliver. The contamination of the web with the foreign matter removed at the crush roll results in a poor quality of sliver and a consequently poor quality of yarn.

SUMMARY OF THE INVENTION

The present invention is particularly adapted for use with a modified form of the Crowley doffer plenum disclosed in said abandoned patent application Ser. No. 587,277. According to the disclosure in that application the doffer plenum is connected to a central source of suction and air is drawn into the plenum through inlets facing toward the nip between the main cylinder and the doffer cylinder and through inlet facing toward the front of the card intended to draw in lint and foreign matter released at the take off roll and the crush roll. A web cover of planar configuration is articulated to the upper front edge of the Crowley doffer plenum and in its operative position extends downwardly at an angle from the horizontal toward the trumpet in overlying relation to the take-off and crush rolls and in overlying relation to the web of fibers extending from the take off roll through the crush rolls and to the trumpet.

According to the present invention, the planar web cover of Crowley is supplemented by down-turned sidewalls and down-turned front wall to provide a totally enclosed web cover, and by a suction chamber affixed to the lower surface of the planar top portion of the web cover. One end of the suction chamber communicates with the front end of the doffer plenum when in operative position and the other end of the suction chamber terminates in overlying relation to the top crush roll and its scraper blade.

The only opening in the front wall of the doffer plenum according to the present invention is a centrally disposed opening which provides communication between the interior of the doffer plenum and the suction chamber beneath the web cover. The suction inlet in the doffer plenum adjacent the main cylinder remains the same as disclosed in said Crowley abandoned application. The doffer plenum, according to the present invention, rests on the conventional doffer cover, which is spaced about ¼ of an inch above the wire clothing on the doffer cylinder and the lower wall of the suction chamber beneath the web cover is correspondingly spaced above the wire clothing on the doffer cylinder. The down-turned side portions also terminate in closely spaced relation to the wire clothing on the doffer cylinder, and arcuate cut outs are provided in the side walls of the web cover to accommodate the brush conventionally supported above the take off roll.

The downwardly turned front wall of the web cover is located forwardly of the crush rolls and supports the operative end portion of a compressed air tube having air outlets directed toward the scraper blade to intermittently discharge blasts of air to clean the scraper blade and direct the foreign matter into the influence of the suction chamber beneath the web cover.

It is an object of this invention to provide a crush roll plenum of the type described wherein there is provided a continuous negative air pressure in the vicinity of the crush rolls and intermittent blasts of compressed air directed against the juncture of a scraper blade with the top crush roll whereby foreign matter is removed from the top crush roll by the blasts of compressed air and carried away by the continuous suction in the air chamber beneath the web cover. The lighter airborne waste from the crush roll is continuously carried away by the air pressure generated by the rapid rotation of the doffer cylinder beneath the crush roll plenum and beneath the doffer plenum, where it is attracted by and drawn into the suction inlet of the doffer plenum opening toward the main cylinder.

DETAILED DESCRIPTION OF THE INVENTION

Figure 1:
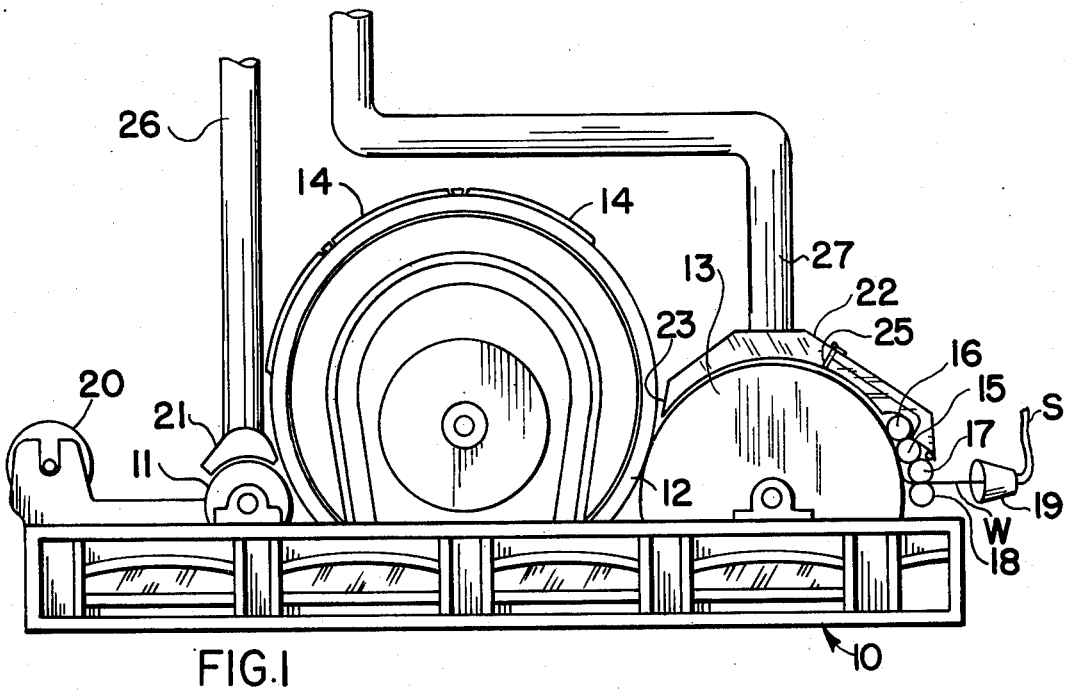
FIG. 1 is a side elevation looking at one side of a carding machine embodying the present invention.

Referring more specifically to the drawings, the numeral 10 broadly designates a carding machine having the usual lickerin 11, main cylinder 12, and doffer cylinder 13. The card may be equipped with revolving flats or stationary flats as desired, stationary flats being indicated at 14. The carding machine also conventionally includes a take off roll 15 and a brush 16 frictonally engagable with the take off roll 15 for cleaning. Upper and lower crush rolls 17 and 18 are mounted forwardly of the take off roll 15 and a trumpet 19 is mounted forwardly of the crush rolls 17, 18.

In conventional carding operation, a lap of fibers 20 to be processed on the carding machine is mounted at the rear of the carding machine and fed into the lickerin 11 rotating in a counterclockwise direction as seen in FIG. 1, which delivers individual fibers to the main cylinder rotating in a clockwise direction in FIG. 1 and which carries the fibers beneath the stationary flats 14 prior to their delivery to a doffer cyliner 13 rotating in a counterclockwise direction in FIG. 1. The take off roll 15, also rotating in a counterclockwise direction in FIG. 1, removes the web of fibers W from the doffer roll 13, from whence the web W passes between crush rolls 17, 18 and thence to the trumpet 19, where it is formed into sliver S and delivered to a coiling can, not shown.

The lickerin, main cylinder, and doffer have rotated at increasingly rapid speeds during the past several years in order to meet the demands for higher production. With the advent of increased speed, the amount of objectionable lint and dust which was released into the atmosphere surrounding the carding machine became objectionable in that it deposited itself in part on the processed web W and the sliver S, thereby contaminating the sliver and rendering a poor quality of yarn. The airborne particles were also objectionable in that they imposed a hazard on the health of the operators of the machine.

Consequently, devices were perfected for carrying off the objectionable airborne lint and dust, one such device being a lickerin plenum indicated at 21 which may be of the type described in U.S. Pat. No. 3,315,320. As more fully appears in said patent, the lickerin plenum 21 includes a first suction inlet opening toward the main cylinder and a second suction inlet opening toward the feed roll, not shown, between the lickerin and the lap 20. The said Crowley abandoned application Ser. No. 587,277 shows a doffer plenum 22 positioned over the doffer cylinder and included a suction inlet opening toward the main cylinder and oppositely directed suction inlets opening toward the crush rolls. The conventional lickerin plenum and doffer plenum are connected to a remotely spaced central collection point as by suction ducts.

A scraper blade 28 is maintained in frictional scraping relation to top crush roll 17 as by a support bar 29 for the purpose of removing accumulations of crushed seeds and other debris taken from the web W by the crush rolls 17, 18. In use, the debris removed from the web W by the crush rolls 17, 18 sticks to the surface of the crush rolls 17, 18 and is removed therefrom in accordance with conventional practice by the scraper blade 28 for the top roll and a smilar scraper blade and support bar, not shown, for the bottom roll 18. These accumulations of debris are relatively heavy compared to the usual airborne lint about a carding machine and the accumulations from the top roll 17 removed by scraper blade 28 naturally tend to fall by gravity toward the floor and are oftentimes caught in the web W beneath top crush roll 17. As has been explained, this results in a poor quality of sliver which correspondingly reduces the quality of the yarn made therefrom.

The foregoing structure is conventional and in prior practice the front wall of the doffer plenum had a row of inlet openings or a continuous slot extending across the width of the carding machine. In the present invention the suction inlets in the front wall of the plenum are replaced by a centrally located port 24 and a crush roll plenum, broadly indicated at 30, is hingedly connected as at 31 to the upper front edge of doffer plenum 22 above the centrally located opening 24. The crush roll plenum 30 is made of transparent plastic for the purpose of enabling an operator of the card to visually examine the condition of the web W therebeneath at any time. In the event of a stoppage it is necessary for the operator to introduce a leading portion of the web W into the nip of the crush rolls 17, 18 and it is desirable to raise the crush roll plenum 30 for this purpose just as it had been conventional practice to raise the transparent planar web cover heretofore used.

The transparent crush roll plenum 30 includes a planar top wall 32 from the opposite sides of which depend side walls 33 and 34. The side walls 33 and 34 each extend to closely spaced relation to the doffer cylinder 13 and generally conform at their lower edges to the curvature of the doffer cylinder 13. Each ofthe side walls 33 and 34 is provided with an arcuate cut out 35 extending into its corresponding wall from its lower edge to accommodate the brush 16 positioned to clean the take off roll 15. The plenum 30 also includes a front wall 36 extending between side walls 33 and 34 and located forwardly of the crush rolls 17, 18. Thus, the plenum 30 extends forwardly from the doffer plenum 22 and over the take off roll 15 and crush rolls 17, 18 to protect the processed web from airborne lint and debris.

According to the invention, the heavier debris from the top crush roll 17 is caught and carried away before it can fall into the web W. For this purpose the suction chamber 40 of plenum 30 depends from top wall 32 of plenum 30 and is located between side walls 33 and 34 of plenum 30. As most clearly seen in FIG. 2, the suction chamber 40 is of truncated triangular configuration with its widest or base portion corresponding with the distance between the front ends of side walls 33, 34. The top wall 32 of plenum 30 also defines the top wall of suction chamber 40 and the marginal tapered sides 41 and 42 of suction chamber 40 are formed by strips of transparent plastic adhered to the inner surface of top wall 32. The forward ends of chamber side walls 41 and 42 join with the front ends of plenum side walls 33 and 34 and walls 41 and 42 taper inwardly toward each other from their junctures with respective side walls 33 and 34 to the rear of plenum 30 beneath hinge 31. The rearward ends of side walls 41, 42 are spaced apart to form the lateral edges of an inlet opening 43 for the suction chamber 40. The upper edge of the opening 43 is defined by the top wall 32 of the plenum 40 and the bottom edge of opening 43 is defined by a bottom wall 44 of suction chamber 40, which is joined to the lower edges of side walls 41, 42. The inlet opening 43 is suction chamber 40 is dimensioned to register with the inlet opening 24 in the front wall 25 of doffer plenum 22 when the plenum is in its lowered or operative position of FIG. 2.

Figure 4:
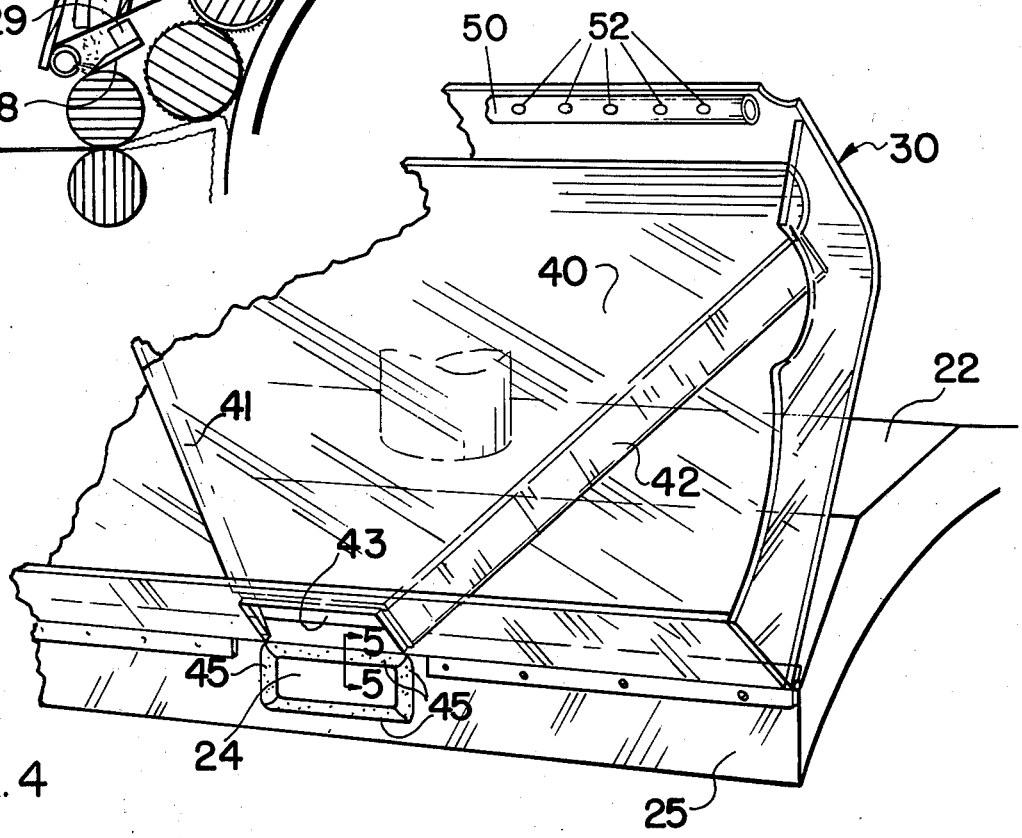
FIG. 4 is an elarged fragmentary view, with parts broken away, showing the crush roll plenum in raised position.
Figure 5:
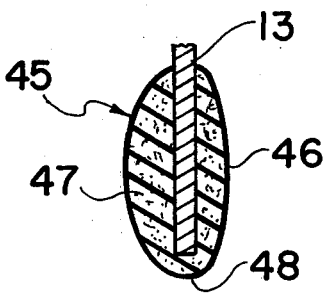
FIG. 5 is a vertical sectional view taken substantially along the line 5—5 in FIG. 4.
Figure 6:
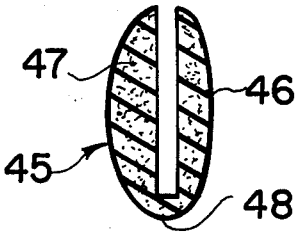
FIG. 6 is a view similar to FIG. 5 but showing the grommet removed from the doffer plenum.

Referring to FIG. 4, wherein the plenum 30 is in the raised or inoperative position and the openings 24 and 43 are separated, it can be seen that the edges of opening 24 in doffer plenum 22 are covered with a grommet 45 comprising a piece of elastomeric material which is of generally U-shaped configuration in cross section and has an inner supporting leg 46 and an outer bearing or sealing leg 47 connected by a bridge portion 48. The grommet 45 is preferably of a continuous configuration and molded into the opening 24 in plenum 22.

Figure 2:
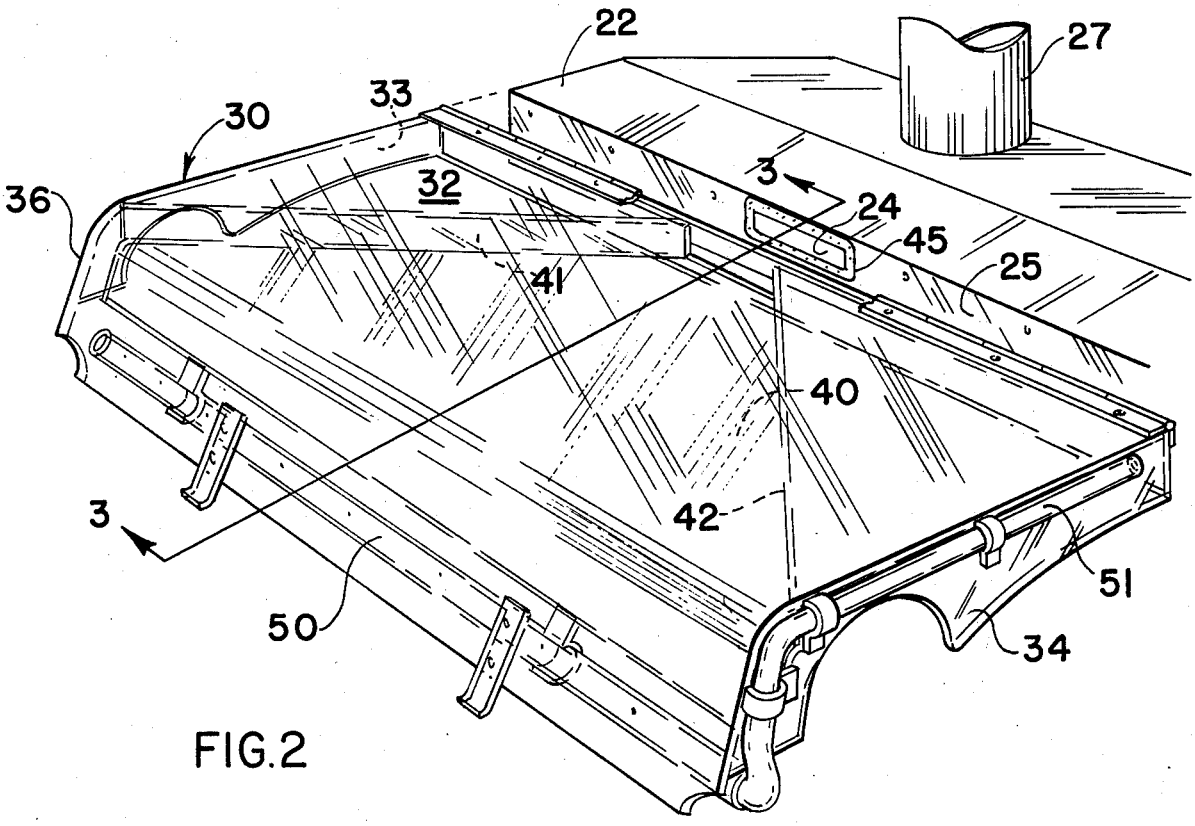
FIG. 2 is an exploded fragmentary perspective view, with parts broken away, of the crush roll plenum and its associated doffer plenum.
Figure 3:
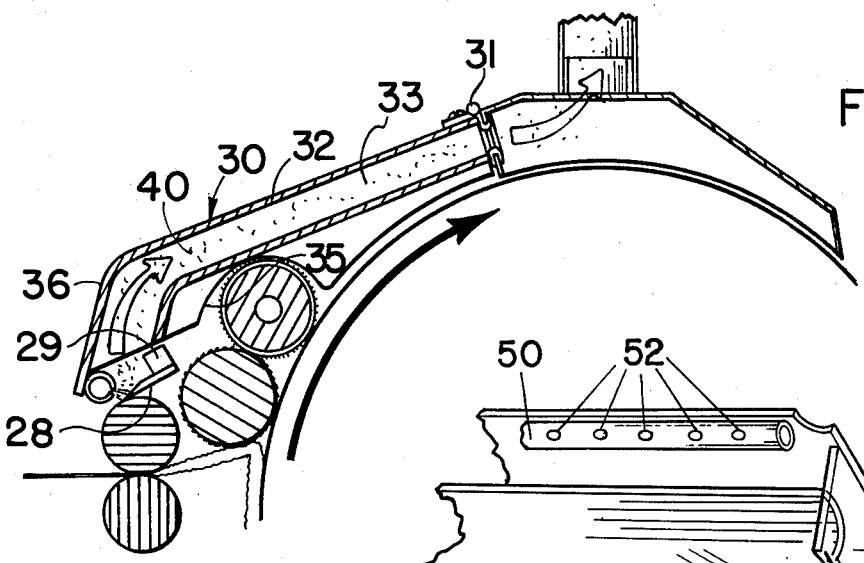
FIG. 3 is a vertical sectional view taken substantially along the line 3—3 in FIG. 2.

When the crush roll plenum 30 is lowered into operative position, the opening 43 is plenum 30 registers with opening 24 in doffer plenum 22 as is apparent in FIGS. 2 and 3. Continuous suction is applied to the lickerin plenum 21 and the doffer plenum 22 during normal operation of the carding machine, and with the plenum 30 lowered to its operative position of FIGS 2 and 3 the grommet 45 about opening 24 defines an effective seal to establish continuous suction through the suction chamber 40.

The bottom wall 44 of suction chamber 40 extends from opening 43 in generally parallel relation to the top wall 32 to a point 46 where it curves downwardly and continues in spaced substantially parallel relation to front wall 36 of plenum 30. The front end of bottom wall 44 terminates in superposed relation to the support bar 29 of scraper blade 28 for top crush roll 17. The lower end of front wall 36 of plenum 30 extends downwardly lower than the terminal front end of bottom wall 44 and is located forwardly of crush roll 17, so that crush roll 17 lies between, but lower than, the terminal ends of front wall 36 and bottom wall 44. The space between the lower terminal end of front wall 36 and bottom wall 44 defines a suction inlet for suction chamber 40 and a continuous negative pressure is drawn across crush roll 17 during operation of the card.

Affixed to the inner surface of front wall 36 and extending across the width of the card is a manifold 50 connected by piping 51 to a source of compressed air, not shown. The manifold 50 has a plurality of air outlet openings or jets 52 spaced along the length of the manifold and opening toward the juncture of scraper blade 28 with top crush roll 17. A timing device, not shown, is desirably interspersed in piping 51 between manifold 50 and the source of compressed air to deliver compressed air through the jets 52 on a predetermined cycle such as, for example, a burst of air of 8 to 12 seconds duration every 5 minutes. The compressed air may be continuous, if desired, or the timing interval may be changed as desired. The intent is to dislodge accumulations of waste from the crush roll 17 after it is loosened by scraper blade 28 and blow the waste into the influence of the continuous suction drawn through the suction inlet at the forward end of plenum 40 immediately above top crush roll 17.

So arranged the intermittent bursts of compressed air combine with the constant suction to effectively remove accumulations of both light and heavy material from the crush roll and conveys it through the crush roll plenum 30 and to a central collection point through exhaust tube 27. Some of the lighter waste such as lint and dust is carried by the surface air currents of the doffer cylinder beneath the bottom wall 44 of suction chamber 40 and beneath doffer plenum 22 to the suction inlet 23 of doffer plenum 22, from where they enter plenum 22 and are carried away through exhaust tube 27. Such an arrangement effectively prevents the waste material from being deposited on the web W and thereby helps insure a high quality sliver and resulting yarn product.

Although specific terms have been employed in the specification and drawings they are used in a descriptive sense only and not for purposes of limitation, the scope of invention being defined by the claims.

We claim:

1. In a carding machine having a main cylinder and a doffer cylinder, top and bottom crush rolls with scraper blades operatively associated therewith and a doffer plenum supported above the doffer cylinder, a crush roll plenum extending forwardly from the doffer plenum toward the crush rolls and comprising:

a. a suction chamber including
   1. a top wall,
   2. side walls depending from the top wall,
   3. a bottom wall extending between the side walls of the suction chamber, and
   4. a suction inlet opening toward the top crush roll, b. means connecting said crush roll plenum to said doffer plenum for relative movement thereto into and out of operative position, c. means establishing communication between the interior of said doffer plenum and the interior of said suction chamber when in the operative position, d. said means for establishing communication between the interior of said doffer plenum and the interior of the suction chamber comprising a front wall in the crush roll plenum and openings in the front wall of said doffer plenum and the front wall of the crush roll plenum dimensioned to register with each other, e. the side walls of the suction chamber extending outwardly from the front wall of the crush roll plenum and terminating in overlying relation to the top crush roll, f. the bottom wall of said suction chamber joining the side walls of the suction chamber at their juncture with the opening in the front wall of the crush roll plenum and extending downwardly from the opposite end portions of said side walls toward the top crush roll and terminating in closely spaced relation to the scraper blade for the top crush roll, g. said top wall of the suction chamber including a downturned portion spaced forwardly from and extending in parallel relation to the downturned front portion of the bottom wall to define the said suction inlet opening toward the top crush roll, h. a manifold having a plurality of air outlet openings extending axially therealong and facing the juncture of the scraper blade with the top crush roll, and i. means for introducing compressed air on a predetermined cycle into said manifold.

* * * * *